United States Patent [19]

Parkes et al.

[11] 4,045,086

[45] Aug. 30, 1977

[54] PUMPABLE PRODUCT HYDRAULIC MINING APPARATUS AND METHOD

[75] Inventors: David M. Parkes, Calgary; Thomas Brian Hart, Fernie, both of Canada

[73] Assignee: Kaiser Resources Ltd., Vancouver, Canada

[21] Appl. No.: 707,701

[22] Filed: July 22, 1976

[30] Foreign Application Priority Data

Apr. 6, 1976 Canada ..... 249699

[51] Int. Cl.[2] ..... E21C 25/60

[52] U.S. Cl. ..... 299/17; 241/76; 241/81; 241/186 R; 299/18; 302/15

[58] Field of Search ..... 241/186 R, 154, 81, 241/76; 302/14, 15; 209/261, 307, 257; 299/8, 7, 18, 17

[56] References Cited

U.S. PATENT DOCUMENTS

| | | | |
|---|---|---|---|
| 2,095,601 | 10/1937 | Hope | 241/76 |
| 3,790,214 | 2/1974 | Kilroy | 299/8 |
| 3,845,990 | 11/1974 | McCain | 302/15 |
| 3,951,457 | 4/1976 | Redford | 299/17 |
| B 425,462 | 3/1976 | Umphrey et al. | 241/81 |

*Primary Examiner*—Ernest R. Purser
*Assistant Examiner*—William F. Pate, III
*Attorney, Agent, or Firm*—Naylor, Neal & Uilkema

[57] ABSTRACT

A method and apparatus for hydraulic mining wherein the mined product is reduced to a pumpable form. The apparatus includes a jet monitor for dislodging the mined product from its in situ state, a feeder-breaker for receiving the mined product, preliminarily separating the pumpable constituent of the product and then subjecting the remaining product to successive breaking and separating steps until the entire product is in a pumpable state. The feeder-breaker is also provided with a sump to collect the pumpable product and pump means to convey the product from the sump under pressure, whereby transport of the product is not dependent on gravity. In the preferred embodiment, the feeder-breaker is provided with a secondary jet monitor to reduce oversized constituents of the mined product to a size suited for the successive separating and breaking steps.

12 Claims, 6 Drawing Figures

PUMPABLE PRODUCT HYDRAULIC MINING APPARATUS AND METHOD

BACKGROUND OF THE INVENTION

The present invention relates to a feeder-breaker apparatus and method for use in the hydraulic mining of friable materials such as coal, tar sands and uranium. It is particularly directed to such an apparatus and method wherein the mined product is reduced to a pumpable form so that it may be pumped under pressure without dependence upon gravity for its conveyance.

In its more particular aspects, the invention is directed to a feeder-breaker wherein breakage of the product is achieved through a principal, high-capacity, single-stage breaker, followed by a secondary breaker. This successive breaker arrangement, as well as the separation steps employed therewith, enables the feeder-breaker to maintain a capacity commensurate with that of high-capacity, single-stage breakers.

The invention is especially concerned with an improvement of mining apparatus and method of the type disclosed in co-pending U.S. patent application Ser. No. 597,985, filed July 22, 1975, by Arthur A. T. Grimley (corresponding to Canadian Application Ser. No. 212,253, filed Oct. 25, 1974). That application discloses a feeder-breaker wherein the breaker is provided with primary and secondary jet monitors, a conveyor, and a breaker mechanism to reduce the size of the mined aggregate being treated. It is not, however, concerned with reducing the mined aggregate to a pumpable form. Rather, it employs a flumed discharge and, thus, is dependent upon the influence of gravity for the ultimate conveyance of the mined product.

Another development relating to the present invention is disclosed in my application Ser. No. 702,072, filed July 2, 1976 and entitled HYDRAULIC MINING APPARATUS AND METHOD. That application discloses a feeder-breaker method and apparatus wherein the mined product is separated into a pumpable constituent and a dry conveyable constituent. To the extent that it separates the pumpable constituent, it is somewhat similar to the invention of the present application. It does not, however, reduce the entire product to a pumpable form.

SUMMARY OF THE INVENTION

The principal component of the apparatus of the invention comprises a conveyor having upstream and downstream sections which are adapted to separate mined aggregate therethrough so that fluid and mined aggregate of a pumpable size are removed from the conveyor as the aggregate is conveyed. It also includes primary breaker means disposed intermediate the upstream and downstream sections of the conveyor so that oversized product is reduced in size as it passes from the upstream to the downstream section. The preferred embodiment also includes a secondary breaker which is disposed either intermediate the upstream and downstream sections, or at the distal end of the downstream section. Through this overall arrangement, the product being treated is subjected to successive breakage and separation steps, and once a portion of the product is reduced to pumpable size, it is not subjected to repeated breakage steps. The end result is that the entire product is reduced to a pumpable form without being subjected to excessive breakage. The apparatus also includes collection means to collect the fluid and the pumpable product and pump means to convey the product from the collection means under pressure.

The method of the invention comprises the steps of conveying aggregate over an elongate continuous conveyor while separating therefrom fluid and aggregate of a pumpable size, subjecting oversized aggregate received on the conveyor to successive primary and secondary breakage to reduce the entire oversized aggregate to a pumpable size, collecting the separated aggregate and fluid and the aggregate reduced in size, and pumping the collected fluid and aggregate under pressure.

OBJECTS OF THE INVENTION

A principal object of the invention is to provide an apparatus and method for the hydraulic mining of friable material wherein the entire material is reduced to a pumpable form so that it may be conveyed under pressure without dependence upon gravity.

Another object of the invention is to provide such an apparatus and method of a high-capacity which subjects the product being treated to a minimum of repeated breakage steps.

Still another object of the invention is to provide an apparatus and method wherein the product being treated is subjected to successive separating steps, both prior to the first breakage step and intermediate the successive breakage steps.

A further object of the invention is to provide such an apparatus and method wherein jet monitors are incorporated to both dislodge the mined material and break up the material once dislodged.

Another object of the invention is to provide such a method and apparatus wherein the pumpable aggregate and fluid are collected and drawn directly into a jep pump for high speed conveyance under pressure.

The foregoing and other objects will become more apparent when viewed in light of the follwoing detailed description and accompanying drawings.

DESCRIPTION OF THE ILLUSTRATED EMBODIMENTS

Figure 1:
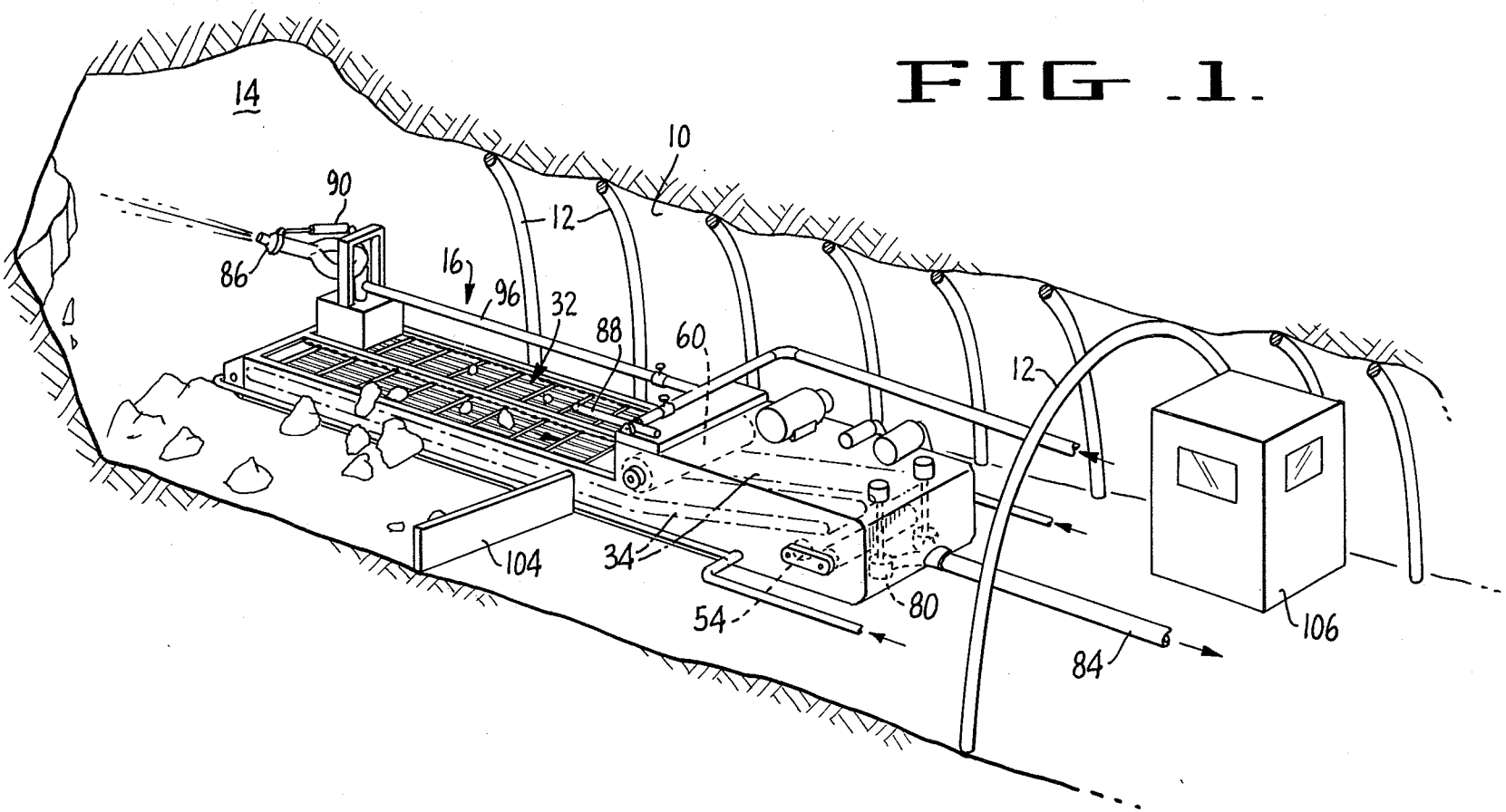
FIG. 1 is a perspective view of a first embodiment of the feeder-breaker of the present invention, as it would appear in a mine shaft.

The mine shaft illustrated in FIG. 1 is designated by the numeral 10 and is shown as being supported by a plurality of arch supports 12. The enlarged portion of the mine being worked is designated by the numeral 14.

Figure 2:
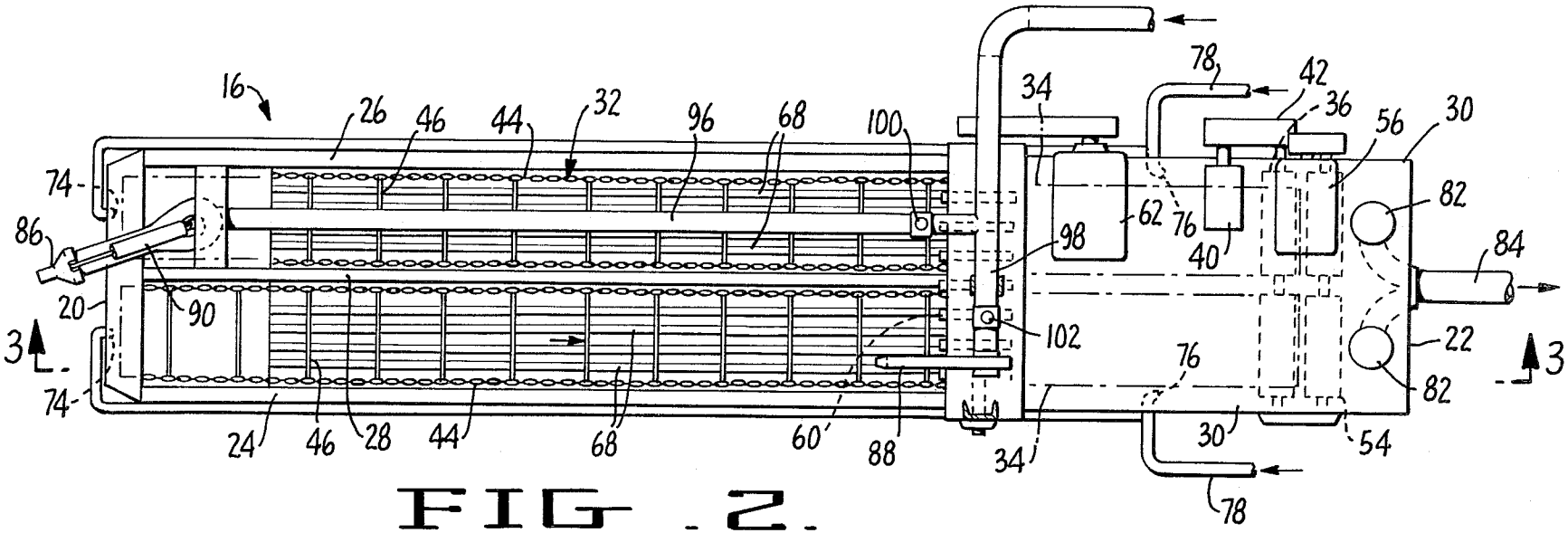
FIG. 2 is a plan view of the feeder-breaker illustrated in FIG. 1.
Figure 3:
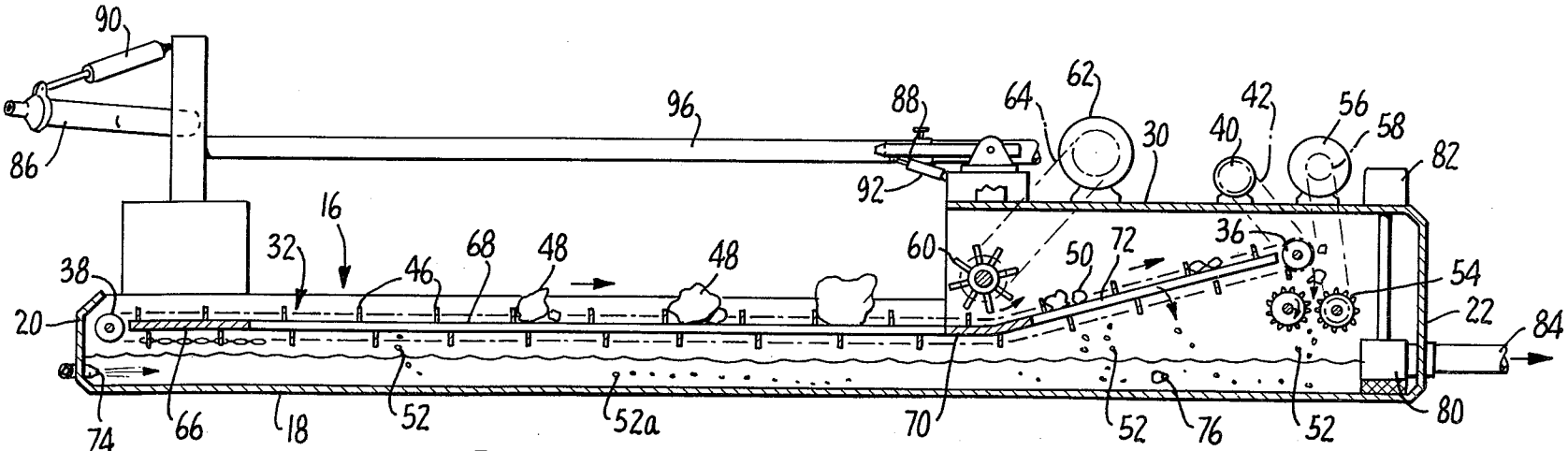
FIG. 3 is a sectional elevational view of the feeder-breaker of FIGS. 1 and 2, taken on the plane designated by Line 3—3 in FIG. 2.

The first embodiment feeder-breaker illustrated in FIGS. 1-3 is designated in its entirety by the numeral 16 and comprises, as its principal component, a generally pan-shaped chassis. The chassis comprises an undersurface 18, end walls 20 and 22, an intermediate wall 28, and an upper platform 30. Although these are the principal components of the chassis, it should be understood that other suitable frame and reinforcing elements may be provided as part of the chassis. The chassis needs to be of considerable strength as it is generally positioned by pushing or pulling through means of a traction vehicle.

The chassis carries an elongate conveyor 32 in the form of a pair of continuous loop belts 34 extending over the length of the chassis. The belts 34 are trained over roller sprockets 36 and 38 at the ends thereof and the sprockets 36 are driven in a clockwise direction by a motor 40 to impart movement to the upper reach of the belt from left to right, as viewed in FIGS. 2 and 3. The motor 40 is mounted on the platform 30. A chain drive 42 establishes a transmission length between the motor 40 and the sprocket 36.

The belts 34 each comprise a pair of chains 44 having transversely extending bars 46 secured thereto and extending thereacross. The bars 46 impart movement to aggregate received by the feeder-breaker and are sufficiently spaced relative to one another that the aggregate may freely fall therebetween. FIG. 3 exemplifies how the aggregate is carried by the belts and shows large aggregate pieces 48 at the upstream section of the conveyor and small aggregate pieces 50 at the downstream section of the conveyor. FIG. 3 also shows relatively fine aggregate pieces 52 falling through the conveyor and being discharged from a rotary crusher 54 at the downstream end of the conveyor. The crusher 54 will also be referred to herein as a secondary breaker. It is driven by a motor 56 through means of a chain transmission 58. The motor 56 is mounted on the platform 30.

FIG. 3 also graphically illustrates the primary breaker 60. This breaker is driven by a motor 62 through means of a chain transmission 64. The motor 62 is mounted on the platform 30. The sections of the conveyor 32 to either side of the primary breaker 60 will hereinafter be referred to as the upstream section and the downstream section. As viewed in FIGS. 2 and 3, the downstream section is that portion of the conveyor to the right of the breaker 60 and the upstream section is that portion of the conveyor to the left of the breaker 60.

The conveyor structure is completed by means of supports extending over substantially the full length of the belts 34 between the upper and lower reaches thereof. Progressing from the upstream end to the downstream end of the conveyor, these supports comprise, for each of the belts 34: a plate 66; wedge bars 68; angle plates 70; and, grizzlies 72. The wedge bars extend longitudinally over substantially the entire length of the upstream section of the conveyor and are so spaced relative to one another as to permit fluid and pumpable aggregate to fall therethrough, while supporting oversized aggregate for conveyance by the bars 46. The grizzlies 72 extend over substantially the entire length of the downstream section of the conveyor and are so proportioned as to permit fluid and pumpable aggregate to fall therethrough, while supporting oversized aggregate for conveyance by the bars 46. Any oversized aggregate departing from the downstream section is received by the cursher or secondary breaker 54 and there reduced to pumpable size. All fluid and pumpable aggregate discharged through the conveyor and the secondary breaker or crusher 54 is collected in a sump formed by the bottom of the feeder-breaker chassis. The conglomerate of material so collected is designated by the numeral **52*a* in FIG. 3. This conglomerate may also comprise water which is injected into the feeder-breaker by nozzles 74 at the upstream end and nozzles 76 adjacent the downstream end. The nozzles are supplied with water under pressure through means of conduits 78 and are provided for the purpose of moving the conglomerate 52*a* to the right, as viewed in FIG. 3. The water injected by the nozzles also functions to somewhat dilute the conglomerate 52*a***.

The downstream end of the feeder-breaker is provided with a pair of sump pumps 80 disposed to be submerged within the conglomerate **52*a*. The pumps are driven by motors 82 and discharge under pressure into a common discharge conduit 84. In operation, the pumps function to continuously remove the conglomerate 52*a* from the collection sump provided by the tray-like chassis of the feeder-breaker and to exhaust this conglomerate into the conduit 84** under pressure. Thus, conveyance of the mined aggregate processes by the feeder-breaker is not dependent upon the influence of gravity.

The basic structure is the first embodiment feeder-breaker apparatus is completed by a principal jet monitor 86 carried by the forward end of the apparatus and a secondary jet monitor 88 carried by the apparatus at an intermediate location disposed generally above the breaker 60. The monitor 86 is provided for the purpose of dislodging material from the mine being worked and is swingable through a large angle of that purpose. A control cylinder 90 is provided to impart swinging movement to the monitor 86. The secondary monitor 88 is provided for the purpose of breaking up mined aggregate which is disposed on and around the feeder-breaker. Its movement is controlled by a cylinder 92 and is somewhat more limited than that of the principal monitor 86.

High pressure water is supplied to the monitors 86 and 88 through means of a main supply conduit 94, which conduit branches into a conduit 96 leading to the monitor 86 and a conduit 98 leading to the monitor 88. Flow control valves 100 and 102 are provided in the conduits 96 and 98, respectively.

The feeder-breaker operates in the manner depicted in FIG. 1. There, it can be seen that large aggregate pieces within the mine shaft collect around the breaker and, ultimately, are received upon and conveyed by the conveyor 32. A barrier 104 is shown to one side of the feeder-breaker and a similar barrier might be provided on the other side of the breaker. The barriers prevent the mined aggregate from moving past the feeder-breaker and assist in directing this aggregate onto the conveyor 32. FIG. 1 also shows a control station 106 for the operator of the feeder-breaker. During normal operation, all operations of the feeder-breaker are remotely controlled from this station.

Figure 4:
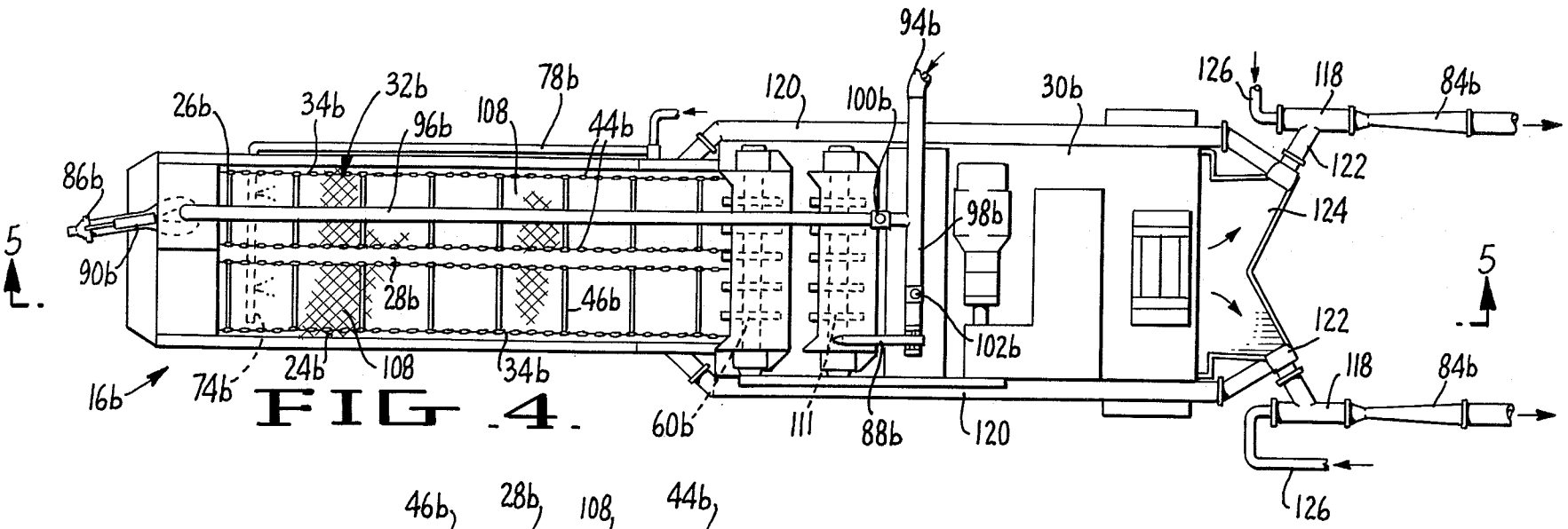
FIG. 4 is a plan view of a second embodiment of the feeder-breaker of the present invention.
Figure 6:
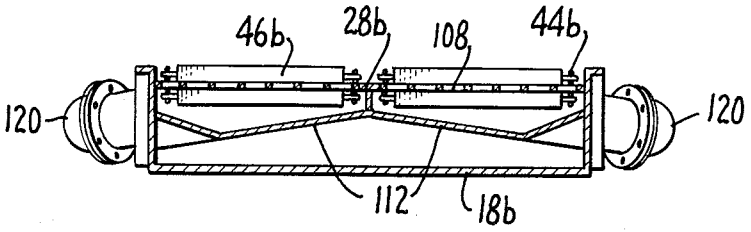
Figure 5:
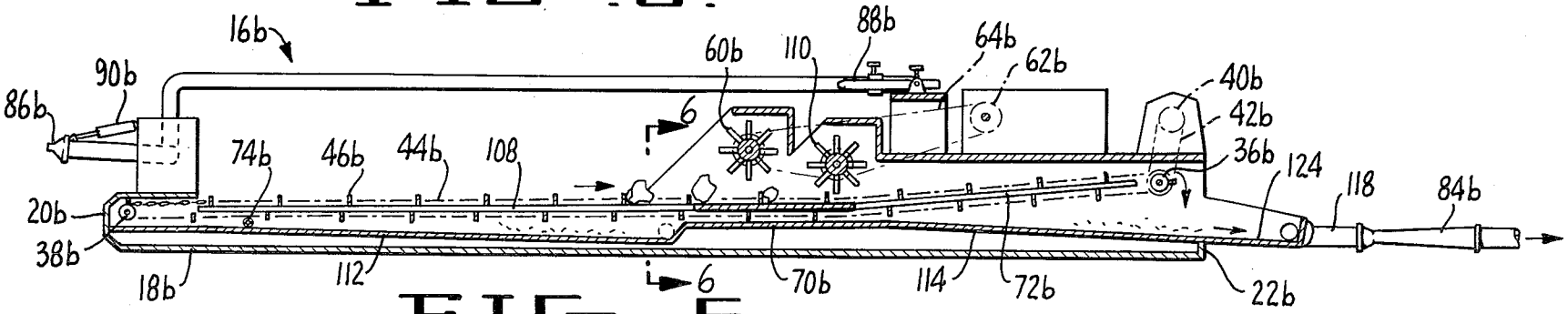
FIG. 5 is a sectional elevational view of the FIG. 4 feeder-breaker, taken on the plane designated by Line 5—5 in FIG. 4; and, FIG. 6 is a cross-sectional view of the feeder-breaker of FIGS. 4 and 5, taken on the plane designated by Line 6—6 of FIG. 5.

The second embodiment of the feeder-breaker (See FIGS. 4, 5 and 6) differs from the first embodiment described above primarily in the following respects: (1) the supports for the upstream section of the conveyor comprise screen decks 108, rather than wedge bars; (2) the secondary breaker is a high-speed rotary breaker 110 located immediately downstream from the primary breaker, rather than an opposed roller crusher disposed at the discharge end of the conveyor; (3) a two-part collection pan is provided within the breaker-feeder chassis, one part 112 being disposed beneath the upstream section of the conveyor and the other part 114 being disposed beneath the downstream section of the conveyor; and (4) jet pumps 116, rather than sump pumps, are provided to withdraw the conglomerate collected within the collection pans.

The second embodiment feeder-breaker is designated by the numeral **16*b*** and parts of this embodiment which correspond to those of the first embodiment are designated by like numerals, followed by the letter *b*. These corresponding parts are as follows: undersurface **18*b*; end walls 20*b* and 22*b*; side walls 24*b* and 26*b*; intermediate wall 28*b*; upper platform 30*b*; conveyor 32*b*; belts 34*b*; roller sprockets 36*b* and 38*b*; motor 40*b*; chain drive 42*b*; chains 44*b*; bars 46*b*; primary rotary breaker 60*b*; motor 62*b*; chain transmission 64*b* (this drives both the primary breaker 60*b* and the secondary breaker 110); plates 70*b*; grizzly 72*b*; nozzles 74*b*; conduit 78*b*; discharge conduits 84*b*; principal jet monitor 86*b* and secondary jet monitor 88*b*; cylinder 90*b*; conduits 94*b*, 96*b* and 98*b*; and, valves 100*b* and 102*b***.

The screen deck 108 functions in substantially the same manner as the aforedescribed wedge bars 68 in that it is provided with openings of a size so limited that only pumpable aggregate can fall therethrough. Typically, these openings are approximately three inches across.

The secondary breaker 110 is provided to reduce the size of any oversized aggregate departing from the primary breaker **60*b*. Typically, the primary breaker 60*b* is set for an eight-inch crush and the secondary breaker 110** is set for a three-inch crush.

The two-part collection pan comprised of the parts 112 and 114 functions to initially segregate the pumpable aggregate separated out in the upstream and downstream sections of the conveyor. Ultimately, however, all of the aggregate is commingled and pumped away by the jet pumps 118. Conveyance from the pan parts 112 to the jet pumps 118 is provided by conduits 120 which extend from fluid communication with the lowermost portions of the parts 112 to the inlets, designated 122, of the jet pumps. Conveyance from the pan part 114 to the jet pumps 118 is provided by a divergent end 124 which forms part of the part 114 and communicates with the inlets 122 of the jet pumps. High-pressure driving water is provided to the jet pumps through means of conduit 126.

The operation of the second embodiment is similar to that of the first embodiment in that it provides for reduction of the entire product to a pumpable form. The principal difference between the operation of the first and second embodiments is that no separation occurs between the primary and secondary breakers in the second embodiment. Insofar as use of the second embodiment apparatus is concerned, it would be substantially the same as that depicted in FIG. 1 for the first embodiment.

CONCLUSION

From the foregoing detailed description, it is believed apparent that the present invention enables the attainment of the objects initially set forth herein. It should be understood, however, that the invention is not intended to be limited to the specifics of the illustrated embodiments, but rather is defined by the accompanying claims.

What is claimed is:

1. An hydraulic mining apparatus comprising, in combination: a perforate continuous loop belt conveyor having upstream and downstream sections and a reach extending over the length of said sections, the belt of said conveyor being sufficiently open to permit the substantially unrestricted passage of mined aggregate therethrough and having perforate supports extending beneath said reach and over the length of said upstream and downstream sections, said supports having openings therein sized to permit aggregate of a pumpable size to pass therethrough while preventing the passage therethrough of aggregate greater than pumpable size; primary breaker means disposed intermediate said sections to reduce the size of oversized aggregate passing from said upstream section to said downstream section; collection means disposed beneath said supports to collect fluid and aggregate passing therethrough; and, pump means communicating with said collection means to withdraw and pump fluid and aggregate therefrom and convey the same under pressure.

2. An apparatus, according to claim 1, further including secondary breaker means disposed intermediate said sections and downstream from said primary breaker means to reduce oversized aggregate departing from the primary breaker means to a pumpable size.

3. An apparatus, according to claim 1, further including secondary breaker means disposed at the downstream end of said downstream section to reduce oversized aggregate departing from said downstream section to a pumpable size and wherein said collection means is disposed to collect aggregate discharged from said secondary breaker means.

4. An apparatus, according to claim 1, wherein said pump means comprises a sump pump disposed within said collection means for submersion in the material collected therein.

5. An apparatus, according to claim 1, wherein said pump means comprises a jet pump having an inlet in fluid communicating with said collection means.

6. Apparatus, according to claim 1, further comprising a first jet monitor carried by said apparatus at the upstream end of the conveyor for dislodging material from a mine within which the apparatus is working and a second jet monitor carried by said apparatus intermediate said upstream and downstream sections of the conveyor for breaking up dislodged mined material disposed around and on said apparatus.

7. An apparatus, according to claim 1, wherein the collection means comprises an elongate pan extending beneath said perforate supports.

8. An apparatus, according to claim 1, wherein: the collection means comprises a first pan disposed beneath said upstream section and the support therefor and a second pan disposed beneath said downstream section and the support therefor; and the pump means comprises a jet pump having an inlet in fluid communication with both of said pans to withdraw fluid and pumpable aggregate therefrom.

9. An hydraulic mining apparatus comprising, in combination: a perforate continuous loop belt conveyor having upstream and downstream sections and a reach extending over the length of said sections, the belt of said conveyor being sufficiently open to permit the substantially unrestricted passage of mined aggregate therethrough and having an upstream support extending beneath said reach over the length of said upstream section and a downstream support extending beneath said reach over the length of said downstream section, at least said upstream support having openings therein sized to permit aggregate of a pumpable size to pass therethrough while preventing the passage therethrough of aggregate greater than pumpable size; primary breaker means disposed intermediate said sections to reduce the size of oversized aggregate passing from said upstream section to said downstream section; secondary breaker means disposed downstream from said primary breaker means to reduce oversized aggregate departing from the latter means to a pumpable size; collection means disposed to receive fluid and pumpable aggregate from said conveyor and secondary breaker means; and, pump means communicating with said collection means to withdraw and pump fluid and aggregate therefrom and convey the same under pressure.

10. Apparatus, according to claim 9, further comprising a first jet monitor carried by said apparatus at the upstream end of the conveyor for dislodging material from a mine within which the apparatus is working and a second jet monitor carried by said apparatus intermediate said upstream and downstream sections of the conveyor for breaking up dislodged mined material disposed around and on said apparatus.

11. A method of treating and conveying hydraulically mined aggregate, said method comprising: conveying said aggregate over an elongate perforate continuous loop belt conveyor having upstream and downstream sections and a reach extending over the length of said sections, the belt of said conveyor being sufficiently open to permit the substantially unrestricted passage of mined aggregate therethrough and having perforate supports extending beneath said reach and over the length of said upstream and downstream sections, said supports having openings therein sized to permit aggregate of a pumpable size to pass therethrough while preventing the passage therethrough of aggregate greater than pumpable size; subjecting oversized aggregate received on said conveyor to breakage at a point intermediate said upstream and downstream sections to reduce the size of oversized aggregate; collecting the aggregate and fluid which passes through said perforate supports; and, pumping the collected fluid and aggregate under pressure.

12. A method, according to claim 11, further including the step of subjecting any oversized aggregate discharged over the downstream end of the conveyor to breakage to reduce any such aggregate to a pumpable size and the step of collecting the aggregate so broken along with the aggregate which passes through said perforate supports.

* * * * *